United States Patent [19]

Rydeck

[11] 4,355,810

[45] Oct. 26, 1982

[54] GOLF CLUB SWING TRAINING DEVICE

[76] Inventor: Joseph P. Rydeck, 422 Arneill Rd., Camarillo, Calif. 93010

[21] Appl. No.: 219,295

[22] Filed: Dec. 22, 1980

Related U.S. Application Data

[63] Continuation of Ser. No. 115,175, Jan. 25, 1980, abandoned, which is a continuation of Ser. No. 861,984, Dec. 19, 1977, abandoned.

[51] Int. Cl.[3] ..... A63B 69/36

[52] U.S. Cl. ..... 273/186 C; 273/187 A; 273/191 B

[58] Field of Search ..... 273/189 R, 191 B, 183 B, 273/192, 186 R, 186 C, 187 R, 187 A

[56] References Cited

U.S. PATENT DOCUMENTS

| | | | |
|---|---|---|---|
| 1,637,339 | 8/1927 | Glennon et al. | 273/186 C |
| 2,498,006 | 2/1950 | Ridill | 273/189 R |
| 2,777,697 | 1/1957 | Crossot | 273/187 R |
| 2,788,214 | 4/1957 | Tilden | 273/191 B |
| 3,194,565 | 7/1965 | Schroer | 273/186 R |
| 3,246,898 | 4/1966 | Shoaf | 273/186 C |
| 3,300,219 | 1/1967 | Sipos | 273/187 R |
| 3,311,377 | 3/1967 | Holbus | 273/186 D |
| 3,460,837 | 8/1969 | Cassa | 273/191 R |
| 3,473,811 | 10/1969 | Lees | 273/195 R |
| 3,885,796 | 5/1975 | King | 273/186 C |
| 3,992,013 | 11/1976 | Golden | 273/186 D |

FOREIGN PATENT DOCUMENTS

| | | | |
|---|---|---|---|
| 504154 | 4/1939 | United Kingdom | 273/186 C |

*Primary Examiner*—George J. Marlo
*Attorney, Agent, or Firm*—Jackson, Jones & Price

[57] ABSTRACT

The golf swing training apparatus has a plastic grass mat that shows the proper positions for the feet and hips in the modern one piece golf swing, in which the body and the golf club, have to be coordinated. It gives the golfer the positions for putting, chipping, pitching, iron shots, and wood shots.

A plastic or rubber guideway for the golf club is built into the mat and it shows the golfer how to position and also how to rotate his shoulders properly. The guideway shows visually, mentally, and physically how to swing the club through properly in the one piece, moder golf swing. That is on are that starts straight back, then to the inside, on the backswing. On the downswing it comes down inside, then straight through at the ball area, then back inside.

There is a novel tension spring in the guideway that squares the golf club face to the target and makes the ball go straight.

The back end of the guideway is flared out so that incorrect swings are corrected while the golfer is learning.

There is also a tension device that is used for pitch shots, iron shots, and wood shots that trains the golfer into the correct foot and leg action. It also shows him how to resist or hold back with his upper body while his lower body starts the downswing. This is very important in the modern one piece swing.

Another novel feature of this apparatus is that the plastic grass mat rolls up into the guideway so the training apparatus can be used at home or easily taken to the office, school, or practice range. It can be used without balls, with plastic balls or with real golf balls.

5 Claims, 6 Drawing Figures

GOLF CLUB SWING TRAINING DEVICE

This is a continuation of application Ser. No. 115,175, filed Jan. 25, 1980, now abandoned, which was a continuation of application Ser. No. 861,984, filed Dec. 19, 1977, now abandoned.

BACKGROUND OF THE INVENTION

When the golf swing was first brought to the United States from England and Scotland, it was basically a hand swing. This was a swing where the hands and arms were very active and not coordinated with the entire body of the golfer.

This type of swing is still used by most amateurs and high handicap golfers in this country. Over the years though this hand swing evolved into what is called the modern one piece swing.

Ben Hogan was one of the first originators of this one piece swing and one of its chief exponents. It is now used by most of our leading professionals and low handicap amateurs in this country.

In this modern swing, the shoulders, arms, and hands move back as one intergral unit as a triangle. The hands only hold the club and the wrists work as a hinge.

In putting and chipping, a golfer uses only his upper-body above the hips. The left chest and shoulder push the club back and then pull the club forward through the ball. The swinging centrifugal force is thus created in the center of the body. The hands and wrists are pulled through the ball by the centrifugal force like a flailing action.

In this one piece modern swing the path of the club is essentially an arc, because it is motivated by the shoulders and not the hands.

On the backswing, the left shoulder starts the club straight back from the ball then the natural turning of the shoulders brings the club inside the target line. On the downswing, the club comes from inside the target line, to straight through the ball area, then back to inside again. Whereas, in the old English swing with the hands supplying the power, the force was coming from outside the body. So the club could swing straight back and straight through, as shown in U.S. Pat. No. 3,586,335, or it could swing inside to outside as shown in U.S. Pat. No. 4,023,810, or it could even swing outside to inside.

Previous training devices were designed for the old English swing. This device is novel because it is designed and offers complete training for the modern one piece swing. Also, in the modern swing, starting with the pitch shots, then the iron shots and full wood shots, as the shoulders push the swing back, they pull back the hips and then the legs and feet.

On the downswing it is just the opposite sequence. The upper body has to resist, or hold back, while the lower body starts the downswing. When the hands are pulled down to hip level, they are then released and as the wrists straighten out in the same flailing action, the club swings through in the same consistant arc, inside to straight through to inside.

That is why in the modern swing it is essential that the feet, hips, and shoulders are lined up in proper relation to the path of the club just as this apparatus does.

SUMMARY OF THE PRESENT INVENTION

This novel golf training apparatus trains a golfer step by step into the modern one piece golf swing.

Step one. The golfer lines himself up in the foot marks for putting, then makes certain his shoulders are aligned properly with the shoulder guide atop the guideway for the club. Then he starts swinging in the putting position with only his left arm and shoulder, the hand only holds the club, and his wrist works like a hinge. Player thinks of swinging back to the figure six but the natural turning of the shoulders brings the club back over the figure seven.

On the forward swing, player thinks of swing to the figure one but the natural turn of the shoulders takes the club over the figure twelve.

When player learns to swing correctly with his left arm and shoulder, the right arm is put on the club and trained to follow the left without overpowering the left.

Step two. When player learns to control with his left side and swing on the line consistently, the next steps are chipping the same way with a wedge and then a seven iron. All those shots are played with just the upper body, the shoulders arms and hands move like a triangle, as one unit, the hips and legs are still.

Step three. In pitching, iron shots and wood shots the legs and feet are pulled back into position, as the shoulders turn back farther. The feet and legs then have to start the downswing as the arms and hands resist, or hold back.

Practice with the coil, leg and grip trainer, at this stage, trains the player into holding back with his upper body, while his feet and legs start the downswing.

The left hand grip trainer slips on any club handle, the stretchable cord gives the player the feeling of coiling up like a spring, then the player holds back with his upper body and keeps the cord stretched while his feet and legs start the downswing. When the hands and wrists come down to hip level the player gets the feel of releasing them like the top professionals do, in a flailing action. The stirrup part of this device trains the legs to move in the correct way.

It should be understood that the stretchable cord can be secured to the mat itself.

This modern one piece swing is much more consistent than the English hand swing. This is why in the early Ryder Cup matches the United States won every year, but in recent years England has won the Ryder Cup occasionally because some of the British professionals have changed to the modern one piece swing.

This golf training apparatus trains a player visually, mentally, and physically into a consistent one piece golf swing. The apparatus is also very helpful to instructors in teaching classes of one or more players, as it graphically shows students the correct position and actions for all golf shots.

This apparatus may also be adapted to accomodate left handed players.

REFERRING NOW TO THE DRAWINGS

Figure 1:
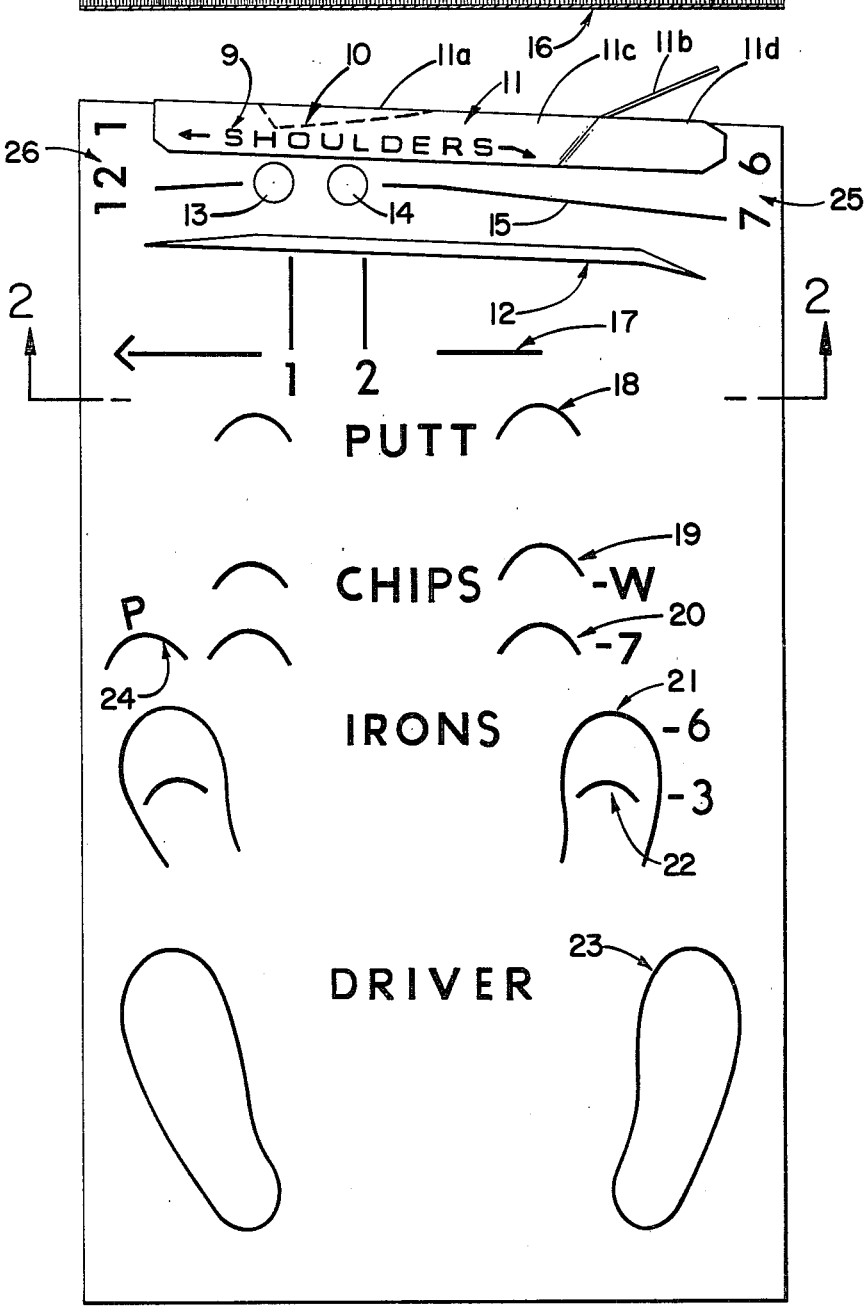
FIG. 1 is a top plan view of the golf training apparatus.

FIG. 1 shows how the shoulders, feet and hips are aligned to the swing line of the club in all golf shots, putting, chipping, pitching, irons, and woods. A flat, plastic grass mat 16 carries a guideway including an outer wall 11 and an inner upwardly extending wall 12. The outer wall 11 includes a straight portion parallel to the inner wall with indicia thereon directing the user to align his shoulders with the straight portion as shown. Reference numeral 18 shows the correct alignment of the feet and hips for putting, with respect to the target line 17. This applies to chips with a wedge at position 19, seven iron at position 20, six iron shot at position 21, three iron shot at position 22, woods or driver at position 23, and pitching with wedge at position 24. The straight portion of the guideway outer wall 11 forms an acute angle with the axis of the target line, as illustrated in FIG. 1 so that a ball following the direction of the straight portion of the outer wall of the guideway would pass forwardly of (or above) the target.

The plastic or rubber outer guideway wall 11 carries a novel tension spring 10 that automatically squares the clubface to the target line as the club swings through the guideway i.e. by pushing the club head rearwardly toward the, inner wall of the guideway 12. Reference numeral 13 represents the ball position for putting and driving where the ball is contacted as the club is ascending. The Reference numeral 14 represents the ball position for all other normal shots where the ball is contacted on the downswing.

The outer wall 11 of the guideway includes an upstanding straight outer wall portion 11*a* joined to a forwardly extending portion 11*b* and a rearwardly extending shoulder 11*c*. The shoulder 11*c* is joined to an upwardly extending guide portion 11*d*.

The line 15 is a visual aid to the player that shows the inside to straight through the ball area back to inside path of the modern one piece golf swing. The reliable plastic grass mat 16, could be made of heavy rubber, vinyl or composition material for golf ranges or schools not desiring portability. Clock positions six and seven are shown at 25 that aid the player mentally on his backswing, positions twelve and one o'clock are shown at 26 to help the player in his mental approach on his forward swing.

On the back swing the player thinks of swinging his club from the ball position of 14, FIG. 1, back to the bold numeral 6, FIG. 1, but the natural turning of his shoulders brings the club head back over the bold number 7, instead. Likewise, on the forward swing the player thinks of swinging through the ball position and out over the bold number 1, but the natural turn of his shoulders takes the club head over the bold number 12, instead.

Figure 2:
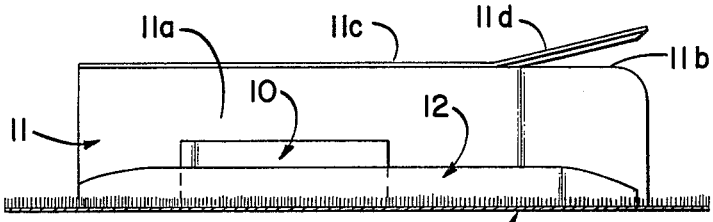
FIG. 2 is a cross sectional view of the apparatus of this invention along line 2—2 in FIG. 1.
Figure 3:
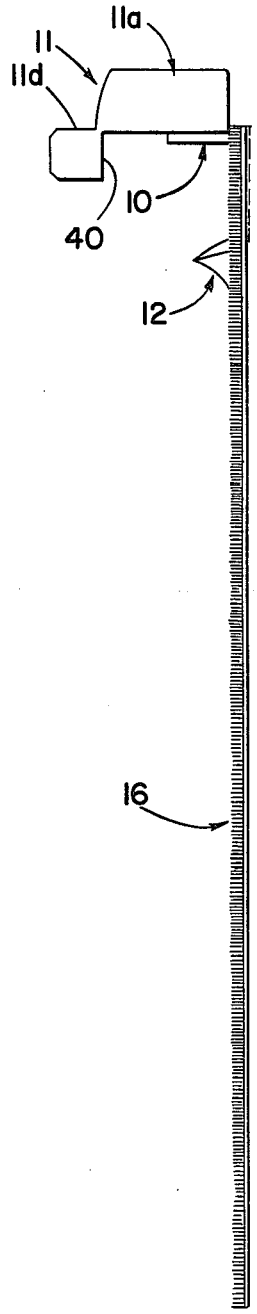
FIG. 3 shows a rear view of the flared club guideway, tension spring, and mat of the invention.

Referring to FIG. 2, the tension spring 10 is carried by the outer wall 11 is illustrated. This figure and FIG. 3 illustrate that the outer wall includes an upwardly extending portion which is parallel to the inner wall 12 and a portion carried by the right edge of the upwardly extending portion which extends away from the inner wall to tend to deflect the club head rearwardly into the guideway as illustrated. The outer wall also includes an overhanging shoulder portion that trains the golfer not to pick the club up on his backswing or forward swing with his hands. The overhanging shoulder portion comprises one section that extends horizontally toward the rear and another section carried by the right edge thereof which extends upwardly toward the right as shown. The inner wall 12 and the tension spring 10 are also shown in this rear view, FIG. 3.

Figure 4:
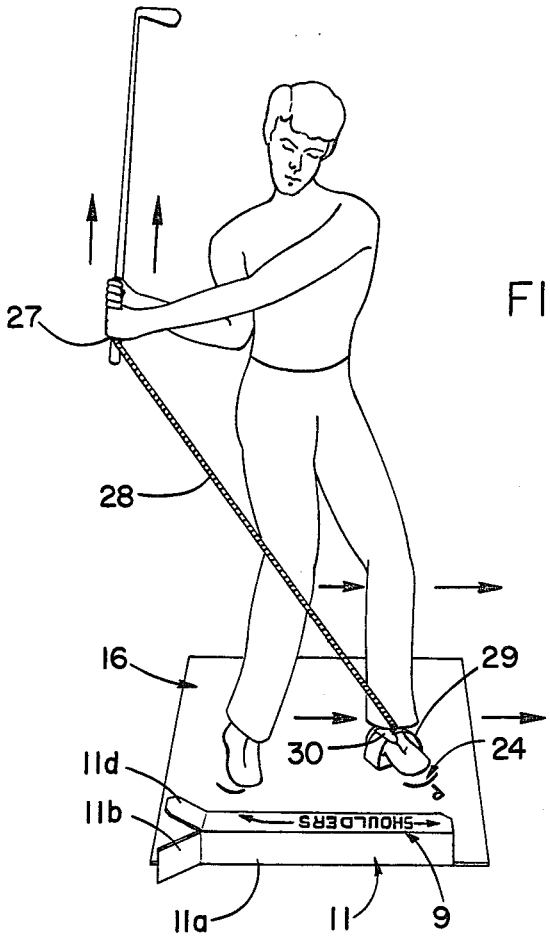
FIG. 4 shows a golfer using the coil leg and grip trainer to get the power from the center of his body on the apparatus.

In FIG. 4 shows a golfer is illustrated using a coil trainer 28 leg trainer 29 and 30 and grip trainer 27.

Figure 5:
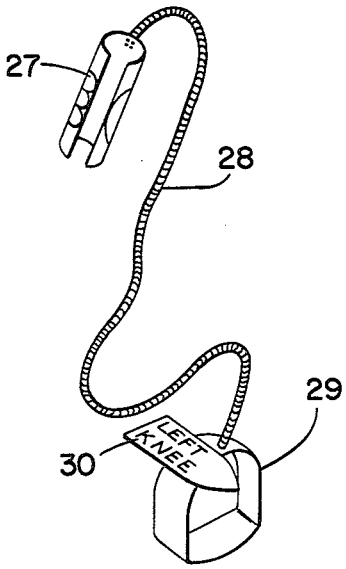
FIG. 5 shows an enlarged view of the coil leg and grip trainer of FIG. 4.
Figure 6:
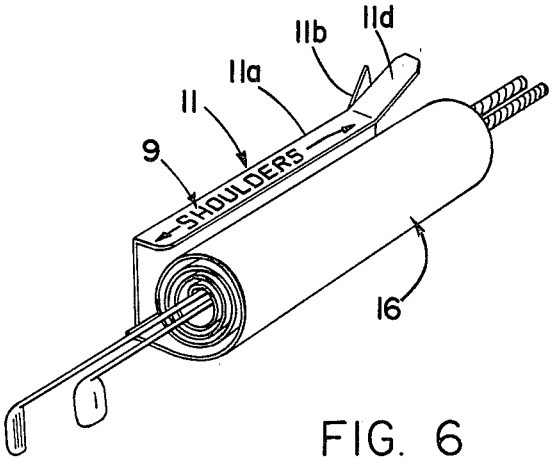
FIG. 6 shows how the plastic grass mat illustrated in FIG. 1 rolls up inside the club guideway with practice clubs inside for easy carrying.

In FIG. 5 the stretchable coil trainer 28 that trains the golfer to resist with his upper body while the feet and legs start the old piece downswing is illustrated in more detail. The leg trainer 29 and 30 train the golfer to use his legs correctly. The grip trainer 27 positions the left hand and arm correctly so the golfer can keep left side control while his shoulders coil him up and his feet and legs uncoil him like a spring.

When not in use the plastic grass mat 16 rolls up into the club guideway 11, with practice golfclubs inside, so it can be taken to practice range, school, or office.

While a few exemplary embodiments have been shown and described, it should be understood that the scope of the invention is not limited to their structure and that the appended claims define the scope of the invention.

What I claim is:

1. A golf swing practice and training device comprising:

(a) a flat mat having a front edge and adapted to lie horizontally on a supporting surface;

(b) a guideway including an outer wall fixed to and extending upwardly from the mat adjacent the front edge thereof, the outer wall having a straight portion and indicia hereon directing the golfer to align his shoulders with the straight portion of the outer wall;

(c) the mat including a rear portion extending rearwardly of the guideway, the rear portion having indicia on the upper surface thereof adjacent the outer wall representing the proper positioning of a golf ball, the rear portion of the mat further having indicia on the upper surface thereof in the form of a target line which points in the direction of the anticipated target, the axis of the target line and an axis through the straight portion of the outer wall forming an acute angle so that a ball following the direction of the straight portion of the outer wall would pass forwardly of the target, the rear portion of the mat further having on its upper surface indicia showing at least the toe positions for the feet of the user when practicing a golf swing, the toe positions being aligned parallel with the target line, whereby for a right hand golfer the toes will be on a line parallel to the target line and the left shoulder will be slightly forward of the right shoulder with respect to the target line when standing to address the ball and visa versa for a left hand golfer.

2. The device of claim 1 wherein the guideway further includes an inner wall defining the rearward extent of the guideway and extending upwardly from the mat and parallel to the straight portion of the outer wall, the inner wall being spaced rearwardly from the outer wall by a distance somewhat greater than the maximum horizontal dimension of a golf club head when swung through the guideway, the indicia representing the proper ball position lying within the guideway.

3. The device of claim 2 wherein the mat has on its upper surface on the left-hand side of the guideway indicia representing the twelve and one o'clock positions and on the right-hand side of the guideway indicia representing the six and seven o'clock positions, the one and six o'clock positions being adjacent the front edge of the mat with the twelve and seven o'clock positions being located rearwardly of the one and six o'clock positions, respectively, so that on the back swing the natural turn of the shoulders will cause the golf club head to pass from the ball position through the seven o'clock position and on the forward swing the natural turn of the shoulders will cause the golf club head to pass from the ball position through the twelve o'clock position, the mat further including indicia connecting the seven o'clock position, the ball position and the twelve o'clock position.

4. The device of claim 3 wherein the mat has indicia on its upper surface showing the positions for the feet of the golfer when using various clubs with the positions of the feet extending progressively rearwardly for a putter, iron, and driver, respectively, and wherein the outer wall of the guideway comprises first, second, and third positions, the first portion extending upwardly from the mat parallel to the inner wall, the second portion extending horizontally toward the rear from the top edge of the first portion to allow a club head to pass beneath the second portion, the third portion being carried by the right edge of the first portion and extending upwardly and away from the inner wall of the guideway to tend to deflect the club head rearwardly into the guideway when the club is swung too far to the front.

5. A golf swing practice and training device comprising:

(a) a flat mat having a front edge and adapted to lie horizontally on a supporting surface;

(b) a guideway fixed to the mat adjacent the front edge thereof, the guideway including an upstanding outer wall with a rearwardly extending shoulder and an upstanding inner wall positioned parallel to and rearwardly of the outer wall by a distance somewhat greater than the maximum horizontal dimension of a golf club head when swung through the guideway;

(c) the mat including a rear portion extending rearwardly of the guideway and having indicia on the upper surface thereof representing the target line for the golf ball, the target line and a line through the center of the guideway forming an acute angle so that a ball following the direction of the guideway would pass forwardly of the target, the rear portion of the mat further having on its upper surface indicia representing at least the correct toe positions for the feet of the golfer when practicing a golf swing with the toe positions being aligned parallel with the target line;

(d) the mat further having on its upper surface indicia representing twelve o'clock, one o'clock, six o'clock and seven o'clock positions, the indicia representing the one and twelve o'clock positions being located on the left side of the guideway with the twelve o'clock position rearward of the one o'clock position, the indicia representing the six and seven o'clock positions being located on the right side of the guideway with the seven o'clock position rearward of the six o'clock position, the indicia representing the seven o'clock and twelve o'clock positions being further located under the proper forward swing of the golf club head, whereby the user may think of swinging the golf club head from the ball position to the six o'clock position in the backswing and from the ball position to the one o'clock position on the forward swing.

* * * * *

UNITED STATES PATENT AND TRADEMARK OFFICE

CERTIFICATE OF CORRECTION

PATENT NO. : 4,355,810

DATED : October 26, 1982

INVENTOR(S) : Joseph P. Rydeck

It is certified that error appears in the above-identified patent and that said Letters Patent are hereby corrected as shown below:

Column 3, line 42, delete "reliable" and insert --rollable--

Signed and Sealed this

*Twenty-second* Day of *February 1983*

[SEAL]

*Attest:*

GERALD J. MOSSINGHOFF

*Attesting Officer*

*Commissioner of Patents and Trademarks*